166-273 SR

12/30/80 XR 4,241,790

United States Patent [19]

Magnie

[11] 4,241,790

[45] Dec. 30, 1980

[54] RECOVERY OF CRUDE OIL UTILIZING HYDROGEN

[76] Inventor: Robert L. Magnie, 945 Detroit St., Denver, Colo. 80206

[21] Appl. No.: 38,488

[22] Filed: May 14, 1979

[51] Int. Cl.[3] ..... E21B 43/20; E21B 43/24

[52] U.S. Cl. ..... 166/260; 166/261; 166/263; 166/273

[58] Field of Search ..... 166/263, 268, 273, 261, 166/256, 260, 251

[56] References Cited

U.S. PATENT DOCUMENTS

| | | | |
|---|---|---|---|
| 1,697,260 | 1/1929 | Cloud | 166/266 X |
| 2,623,596 | 12/1952 | Whorton et al. | 166/266 X |
| 3,051,235 | 8/1962 | Banks | 166/261 |
| 3,102,588 | 9/1963 | Fischer | 166/261 |
| 3,208,514 | 9/1965 | Dew et al. | 166/261 |
| 3,376,924 | 4/1968 | Felsehthal et al. | 166/273 X |
| 3,434,542 | 3/1969 | Dotson | 166/273 |

OTHER PUBLICATIONS

Uren, *Petroleum Production Engineering, Oil Field Exploitation,* 3rd Edition, McGraw-Hill Book Co. Inc., N.Y., 1953, pp. 474, 475.

*Primary Examiner*—Stephen J. Novosad
*Attorney, Agent, or Firm*—Ruel C. Terry

[57] ABSTRACT

Hydrogen is injected into an underground petroleum reservoir that is devoid of natural gas. Due to its high rate of diffusion, hydrogen disperses rapidly throughout the reservoir, including the tight portions that are relatively impermeable to the injection of water. Pressure is lowered in the reservoir when the crude oil is substantially saturated with hydrogen. Hydrogen then migrates from the tight portions of the reservoir, sweeping petroleum into the more permeable portions. Expanding hydrogen experiences a temperature rise which in turn heats the crude oil and further reduces the viscosity for added mobility. A water sweep displaces the oil to production wells. In an alternate embodiment hydrogen is injected into an underground petroleum reservoir as a prelude to fire flood techniques. The absorbed hydrogen dilutes the crude in place and provides a fuel with much wider flammability limits to sustain the underground fire.

5 Claims, 2 Drawing Figures

RECOVERY OF CRUDE OIL UTILIZING HYDROGEN

FIELD OF THE INVENTION

This invention relates to enhanced recovery of petroleum from an underground reservoir. More particularly the invention discloses injection of hydrogen into a reservoir first to dislodge petroleum trapped in tight portions of the reservoir for recovery using displacement techniques, and second to provide a dispersed fuel throughout the reservoir for improved recovery during fire flood procedures.

BACKGROUND OF THE INVENTION

The present invention extends the teachings of my copending application for patent, Ser. No. 947,344, filed Oct. 2, 1978, which is incorporated herein by reference.

It is well known in the art that primary recovery of crude oil from underground reservoirs is enhanced in situations where there is a high degree of dissolved gases within the oil in place. Two particularly useful gases for this purpose are natural gas (methane) and carbon dioxide, both of which are highly soluble in crude oil. These gases aid in recovery by causing reduced viscosity of the oil thereby facilitating its movement to the well bore. Carbon dioxide can play a unique role in petroleum production by extracting lighter fractions of the oil. Hydrogen, although considerably less soluble in oil than methane and carbon dioxide, also has several unique features that can be brought to bear on improving the recovery of petroleum.

A rather considerable amount of crude oil has been discovered in the United States within the last century. An oil reservoir generally is quite non-uniform in character, with wide variations in porosity, permeability, petroleum content, water content and the like from place to place through out the reservoir. It therefore follows that difficulties can be expected in displacing oil in place to a collection point such as a well bore. With over 100 years of experience in oil production techniques, overall oil recovery still remains a relatively small percentage, in the order of 30%, of the original oil in place. Thus there remains in known oil fields, after economic depletion of the reservoir, approximately twice as much oil trapped in the reservoir as was produced during the flush and lean phases of production. This remaining oil is of growing significance as the supplies of available oil change from surplus to shortage as compared to crude oil demand.

The reason substantial quantities of oil remain in place after an oil field has been abandoned is that the cost of producing the oil exceeded its profitable selling price at the time production was terminated. It is possible, of course, to recover virtually all of the oil from a reservoir if cost of production is no object. In the extreme case the petroleum reservoir can be grubbed out with the contents removed to the surface of the earth for separation of the oil from the host rock, the connate water and the like. Such an approach, in addition to being costly also introduces environmental problems of considerable magnitude.

Thus the practical approach is toward more effective recovery of the petroleum from the reservoir by displacement of the oil in place to a series of well bores for recovery. Several schemes of displacement have been developed that increase recovery of crude oil over that which is attainable from natural reservoir drive. Water, for example, can be injected into the reservoir to provide artificial drive which sweeps oil toward production wells. In some cases, particularly when the crude oil is of relatively low API gravity, a portion of the oil in place can be burned by injecting high pressure air with the resultant cracking and distillation of nearby oil into more mobile fractions, which also adds heat to reduce viscosity of unburned oil as well as adding differential pressure to the reservoir.

In the case of ordinary water injection, rarely will oil recoveries exceed 50% of the oil in place. There are two principal problems mitigating against higher recovery: tight formations in portions of the reservoir that exclude penetration of the water and the mismatch between the viscosities of water and oil. As a practical matter there is not much that can be done about opening tight portions of the reservoir so that water flooding can proceed uniformly through this portion of the pay zone. The mismatch in viscosities is much easier to correct by adding soluble polymers to the water in what is known as the micellar slug technique. The reservoir is first treated by injecting detergents to lower the surface tension of the oil, followed by a slug of thickened water containing dissolved polymers, with a final slug of ordinary water being injected to complete the sequence.

In the case of fire floods a portion of the crude oil is burned, generally in the order of 15% of the oil in place, which precludes that portion of the oil from being recovered. Also there is the troublesome problem of keeping the underground fire going in the planned manner of reservoir sweep. In order for a fire to propagate it is necessary to provide injected air in proper proportions to burn the fuel within its limits of flammability. When air volumes are provided outside the limits of flammability, the fire will be extinguished. An improvement can be made, however, by adding a fuel to the reservoir that has significantly wider limits of flammability, as will be more fully disclosed hereinafter.

With the worldwide tightening of crude oil supplies with respect to demand, crude oil prices have risen dramatically and are expected to continue rising as supplies become tighter. This trend of escallating prices changes the economics of crude oil production, making residual oil of previously "depleted" oil fields an attractive candidate for future production. Higher prices also encourage the routine use of production techniques that heretofore were unattractive despite the fact that overall recoveries could be improved. There seems to be no question but what a substantial amount of increased supply of energy required in the United States in the future years will come from a single reliable source; known oil fields using more expensive but effective enhanced recovery techniques. It is an object of the present invention to teach techniques of improved crude oil recovery.

Introduction

Hydrogen is a versatile gas that has numerous attributes that can be employed in enhanced recovery of crude oil. With the highest diffusion rate of all gases, hydrogen rapidly permeates an underground petroleum reservoir upon being injected at elevated pressure. Hydrogen also is soluble in crude oil, although not as soluble as many other gases. Crude oil characteristics vary widely from one reservoir to another. The solubility capability of a medium grade crude oil at a reservoir pressure of 2,000 psi and a temperature of 120° F., expressed in standard cubic feet per barrel, typically is:

TABLE 1

| | |
|---|---|
| hydrogen | 68 |
| carbon monoxide | 83 |
| nitrogen | 70 |
| natural gas | 660 |

Thus upon injection of hydrogen into a petroleum reservoir, a a respectable amount of hydrogen will be taken into solution with the crude oil, causing the oil to swell with resultant reduction in viscosity and increase in mobility. While hydrogen is not in the same class with natural gas in regard to solubility in crude oil, for reservoirs devoid of natural gas, hydrogen is far superior in its capability of rapid dispersement throughout the reservoir. For comparison purposes, taking the diffusion rate of natural gas as unity, diffusion properties are:

TABLE 2

| | |
|---|---|
| natural gas | 1.0 |
| carbon monoxide | 1.1 |
| nitrogen | 1.1 |
| hydrogen | 14.7 |

Hydrogen, with its low specific gravity and high diffusion rate, readily invades tight portions of the reservoir.

Hydrogen also is unique in its escaping from confinement through a small orifice. Virtually all other gases upon release through an orifice experience a sharp temperature decrease, while hydrogen under the same circumstances experiences a sharp temperature rise. Looking now to hydrogen that has invaded the tight portion of a petroleum reservoir and become dissolved in crude oil, upon lowering reservoir pressure, hydrogen will provide a drive to move the oil from the tight portion. This drive is further enhanced by the rise in temperature of the escaping hydrogen, thus further reducing the viscosity of the crude oil and increasing its mobility.

As previously mentioned the fire in a petroleum fire flood often is difficult to keep lit. Hydrogen has much wider limits of flammability than components of petroleum and thus can provided added capability for the sustenance of an underground fire. The limits of flammability, expressed in volume percent, are compared:

TABLE 3

| | lower | upper |
|---|---|---|
| hydrogen | 4.0 | 74.2 |
| natural gas | 5.0 | 15.0 |
| propane | 2.4 | 9.5 |

Thus hydrogen, with its wide range of flammability, dissolved in crude oil can sustain the underground fire when too much or too little air is being fed to the fire for combustion of petroleum components. Hydrogen also is an excellent fuel with a high heat value of about 60,000 BTU/lb. compared to petroleum components which have a heat value in the order of 20,000 BTU per pound.

It generally may be said that the higher the quality of a fuel the more precautions must be taken for its safe use. The characteristics of hydrogen are well known and the precautions for its use are also well known.

Thus it may be seen that hydrogen has many unique properties that can be applied to the problems of improved recovery of crude oil. It will be appreciated that this invention is not limited to any theory of operation, but that any theory that has been advanced is merely to facilitate disclosure of the invention.

SUMMARY OF THE INVENTION

In an underground petroleum reservoir that is devoid of natural gas, hydrogen is injected to permeate the reservoir and become dissolved in the oil in place. Pressure is reduced in the reservoir causing the hydrogen to be removed partially from solution, driving crude from its locked position in tight portions of the reservoir. The resulting temperature rise by expanding hydrogen further reduces the viscosity of the oil, increasing its mobility for collection at producing wells. Production is further enhanced by water displacement of relocated crude oil. In a second embodiment hydrogen is injected into an underground petroleum reservoir in preparation for a fire flood. Hydrogen dissolved in the crude oil decreases the viscosity of the oil and provides a fuel for sustenance of the underground fire over wide ranges of air injection volumes, thus enhancing recovery of crude oil.

DESCRIPTION OF THE PREFERRED EMBODIMENTS

For illustrative purposes a petroleum reservoir is described at a depth of 5,000 feet, with a reservoir pressure of 2,000 psi and a reservoir temperature of 120° F. The reservoir is an anticline and only a portion of the reservoir is shown on the drawings. The overburden is impervious to the passage of hydrogen. The reservoir has an average porosity of 25% and an average permeability of 700 md although there are tight portions within the reservoir with permeabilities of 10 md or less. The crude oil has a gravity of 25° API at 60° F. The petroleum reservoir is essentially devoid of natural gas content. The oil saturation is 80% of pore volume and in one embodiment the net pay thickness is 50 feet and in a second embodiment the pay thickness is 20 feet. Only those wells needed to illustrate the methods of the invention are shown on the drawings.

Figure 1:
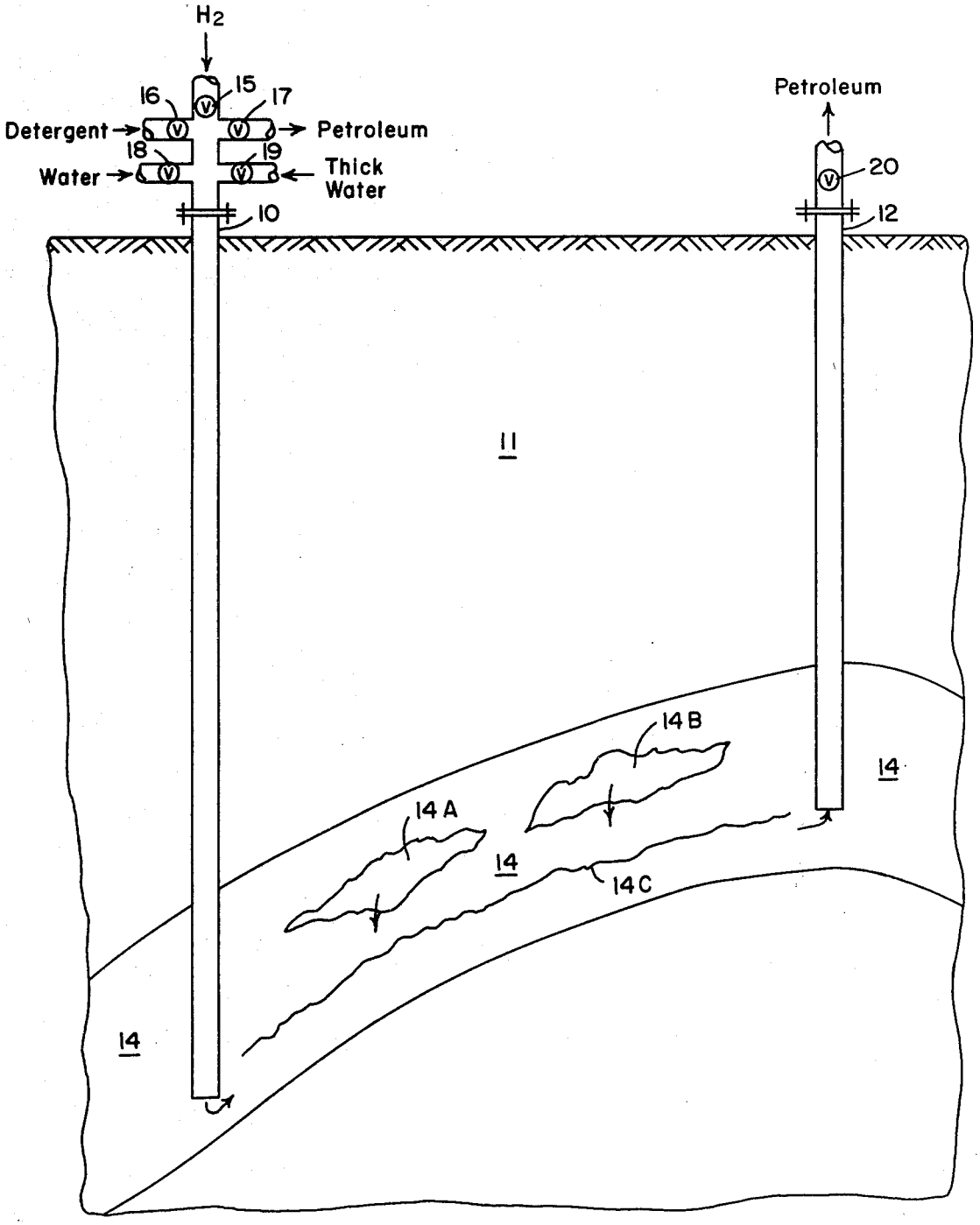
FIG. 1 is a diagrammatical vertical section through a portion of the earth showing arrangement of apparatus for a first embodiment of the invention.

Referring first to FIG. 1, two wells 10 and 12 are drilled from the surface of the earth through overburden 11 and into petroleum reservoir 14. As illustrated reservoir 14 has two tight portions of low permeability, 14A and 14B. The path of maximum permeability between wells 10 and 12 is shown as 14C. Well 10 serves as an injector-producer well and well 12 serves as a pressure relief well and a producer well. The wellhead of well 10 is suitably equipped to permit withdrawal of petroleum and to permit injection of hydrogen, detergent, water saturated with polymers and ordinary water.

The procedure begins with all valves closed. Valve 15 is opened and hydrogen is injected at elevated pressure, for example 3,000 psi. Injection of hydrogen continues until substantially all of the crude oil between wells 10 and 12 is saturated with hydrogen, including the tight portions 14A and 14B. Hydrogen injection is terminated and valve 15 is closed. Crude oil production is begun by opening valve 17 in well 10 and valve 20 in well 12. With the conditions as described, crude oil will flow to the well heads for a considerable amount of time. It is recognized that when crude oil ceases to flow at the surface, additional crude can be produced by providing artificial lift in wells 10 and 12.

During the flow cycle, hydrogen saturated in the crude oil located in 14A and 14B will come out of solution and sweep the crude to the more permeable areas around 14C. Once crude oil production diminishes to relatively low volumes, production is terminated and hydrogen injection is resumed using the injection procedure described above. Hydrogen injection is continued until crude oil saturation is reattained. Hydrogen injection in then terminated and the oil production cycle is resumed using the procedure previously described. The hydrogen injection followed by oil production cycles may be repeated several times until it is apparent from excessive hydrogen returns that the procedures are waining in efficiency.

Once the hydrogen injection-crude oil production cycles suffer an efficiency drop to minimum acceptable levels, the cycles are terminated. The next sequence of cycles begins with all valves closed. Valve 16 is opened and a detergent, selected from those well known in the art for capability of lowering the surface tension of the crude oil, is injected into well 10. Injection of the detergent continues until the detergent is dispersed through the remaining crude in place. In some cases it may be necessary to provide pressure relief to the reservoir by opening valve 20 in well 12.

After the detergent is dispersed, injection of detergent is terminated with valve 16 closed. The procedure continues with the opening of valve 19 and injection of water that is thickened with polymers. Injection of the thickened water continues with valve 20 in well 12 opened to permit flow of oil from well 12 to surface facilities. Since water thickening chemicals are relatively expensive, sufficient thick water is injected to provide a slug that can be driven from well 10 to well 12 with the assistance of a follow-up slug of ordinary water to complete the drive of thick water to break-through at well 12. During water injection the remaining mobilized oil in place between wells 10 and 12 is displaced to well 12 and oil production continues until the water sweep engulfs well 12. By using the heretofore decribed procedures a considerable amount of the oil originally trapped in tight portions 14A and 14B, oil that cannot be reached by water injection, is driven into more permeable areas where water displacement procedures are effective. In this manner oil in place that normally is bypassed can be mobilized for recovery.

Figure 2:
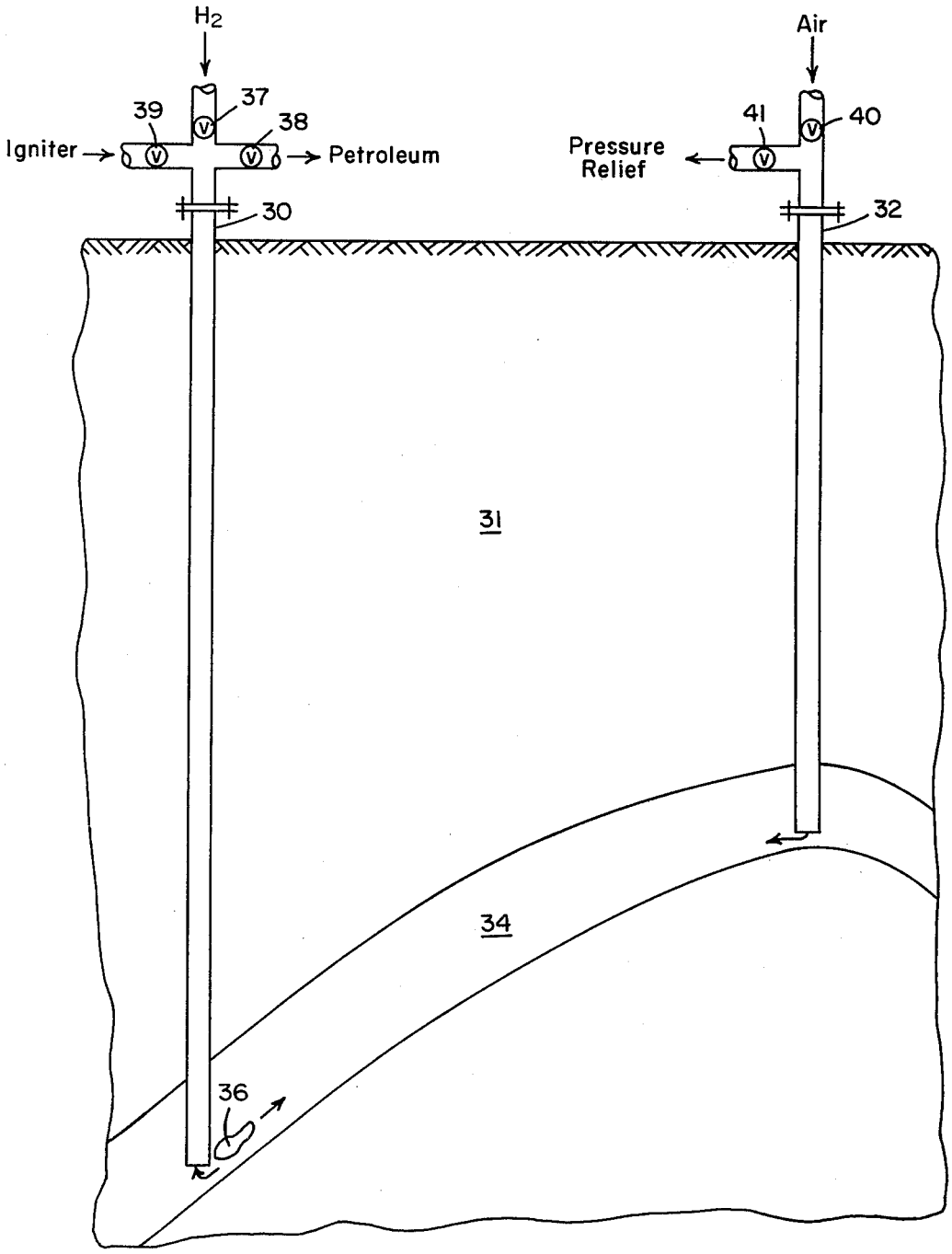
FIG. 2 is a diagrammatical vertical section through a portion of the earth showing arrangement of apparatus for a second embodiment of the invention.

Referring now to FIG. 2, a second embodiment of the invention is illustrated. Two wells 30 and 32 are drilled through overburden 31 and into petroleum reservoir 34, in preparation for petroleum production using fire flood techniques. It is recognized that the planned burn can be conducted as a forward burn or a reverse burn. A reverse burn is generally preferred because a forward burn develops a wall of liquids ahead of the burn which may inhibit production efforts.

The procedure begins with all valves closed. Valve 37 is opened and hydrogen is injected into the underground petroleum reservoir 34 at elevated pressure, for example 2,500 psi. Injection of hydrogen continues until the crude oil between wells 30 and 32 is substantially saturated with hydrogen. To facilitate the dispersion of hydrogen it may be necessary from time to time to provide pressure relief to the reservoir by opening valve 41 in well 32. In some cases the added pressure due to hydrogen injection coupled with the diluting effect of hydrogen in solution may cause petroleum to flow to the surface via well 32 through valve 41. Production in this manner may continue until excessive hydrogen, i.e. an amount of hydrogen significantly greater than the absorption capability of the produced crude oil, is withdrawn through valve 41.

Once the crude oil between wells 30 and 32 is substantially saturated with hydrogen, all valves are closed. The procedure continues by opening valve 40 in well 32 and injecting air into reservoir 34 at elevated pressure, for example 3,000 psi. Pressure relief to the reservoir is provided by cracking valve 38 in well 30. Once air begins to flow through valve 38 it is apparent that air injected through well 32 has broken through to well 30 and favorable conditions exist to begin the underground fire. Valve 38 is closed and an agitator is inserted into well 30 through valve 39. Preferably valve 39 is of the lock hopper type that permits igniter insertion at atmospheric pressure into valve 39, then pressure is increased to reservoir pressure level and the igniter falls through well 30 to reservoir 34. The igniter can be of any useful type but preferably is a pyrotechnic device such as a fuse that ignites upon impact at the bottom of well 30.

When the igniter is actuated at the bottom of well 30, valve 38 is opened to permit circulation of fluids from well 32 through reservoir 34 and on to surface facilities via well 30. Initially the flow through well 38 will be air, followed by products of combustion which signal that the underground fire 36 is underway. Fire 36 will propagate toward the oncoming air and will thus burn through reservoir 34 toward well 32. The fire will consume a portion of the crude oil and its hydrogen in solution. Generated heat will distill and crack nearby oil into lighter fractions which are quite mobile compared to the original oil in place. With pressure relief in this mode provided by well 30, liquids will be driven to well 30 where they are gas lifted by the products of combustion to surface facilities via valve 38. In this manner petroleum is produced until underground fire 36 breaks through to well 32.

An underground petroleum reservoir such as reservoir 34 has widely varying permeabilities from place to place which complicate the problem of providing the correct amount of air to a propagating fire. Hydrogen, with its wide limits of flammability compared to petroleum components, is an ideal fuel under these conditions. By dissolving hydrogen in the reservoir crude oil as disclosed herein, a considerably wider latitude is attained for continuing propagation of the fire in spite of unpredictable fluctuations in air volumes available to the fire face. Dissolved hydrogen also serves another purpose, particularly for crude oil located some distance from the fire, in that the crude oil is made more mobile by the thinning effect of taking hydrogen into solution.

It is therefore apparent that hydrogen serves many useful roles in the enhanced recovery of crude oil. With its exceptional qualities of diffusion, hydrogen readily disperses through out a petroleum reservoir. Hydrogen readily goes into solution in the crude oil, making the oil more mobile. With its low density hydrogen can penetrate tight portions of the reservoir which may be substantially impervious to other injected fluids. The tight portions of the reservoir contain a multiplicity of small orifices, therefore when reservoir pressure is decreased and hydrogen begins to come out of solution, hydrogen experiences a temperature rise which thins the crude oil in addition to providing a gas drive. Crude oil thus moved from tight portions of the reservoir into more permeable locations is available for displacement by ordinary water injection or by the micellar slug technique. Hydrogen, with its wide range of flammability, assists in the sustenance of an underground fire when fire flood techniques are used to recover crude oil with low mobility characteristics.

While the present invention has been described with a certain degree of particularity, it is understood that the present disclosure has been made by way of example and that changes in detail of structure may be made without departing from the spirit thereof.

What is claimed is:

1. In an underground petroleum reservoir that is substantially devoid of natural gas content and wherein the crude oil in place is located both in relatively permeable areas and in relatively impermeable areas, a method of enhanced mobilization of petroleum comprising the steps of establishing a first communication passage from the surface of the earth into the petroleum reservoir, establishing a second communication passage from the surface of the earth into the petroleum reservoir, the second passage being spaced apart from the first passage, injecting hydrogen into the first communication passage and into the petroleum reservoir in such quantity as to substantially saturate the crude oil in place with hydrogen, both in the relatively permeable areas and in the relatively impermeable areas, with the resultant thinning of the crude oil in place and the resultant increase in reservoir pressure, providing pressure relief to the petroleum reservoir with the resultant expansion of hydrogen in the relatively impermeable areas of the reservoir, the resultant increase in the temperature of the expanding hydrogen, and the resultant further thinning of the crude oil wherein hydrogen has been dissolved, terminating pressure relief, injecting water into the first communication passage and into the petroleum reservoir, then producing petroleum through the second communication passage.

2. The method of claim 1 further including the steps of terminating injecting water into the first communication passage and into the petroleum reservoir, terminating petroleum production, injecting a detergent into the first communication passage and into the said petroleum reservoir, the detergent having the capability of reducing the surface tension of the oil in place, terminating injection of the detergent, injecting water thickened with polymers into the first communication passage and into the petroleum reservoir, then producing petroleum through the second communication passage.

3. The method of claim 2 further including the steps of terminating injecting water thickened with polymers into the first communication passage, terminating producing petroleum through the second communication passage, then injecting water into the first communication passage, and producing petroleum through the second communication passage.

4. In an underground petroleum reservoir that is substantially devoid of natural gas content, a method of increasing the flammability of the crude oil in place to facilitate the propagation of an underground fire flood comprising the steps of establishing a first communication passage from the surface of the earth into the petroleum reservoir, establishing a second communication passage from the surface of the earth into the petroleum reservoir, the second passage being spaced apart from the first passage, injecting hydrogen into the first communication passage and into the petroleum reservoir in such quantity as to substantially saturate the crude in place with hydrogen, with the resultant broadening of the limits of flammability of the crude oil, terminating injection of the said hydrogen, then injecting air into the second communication passage, igniting the crude oil and its absorbed hydrogen in the first communication passage, continuing injection of air with the resultant propagation of the underground fire toward the second communication passage, and recovering petroleum and the products of combustion through the first communication passage.

5. The method of claim 4 further including the step of providing pressure relief to the reservoir through the second communication passage during the said injecting of hydrogen.

* * * * *